United States Patent [19]

Capdeboscq

[11] 4,219,294

[45] Aug. 26, 1980

[54] MACHINE FOR SEPARATING AND DISCHARGING PRODUCTS IN SHEET FORM

[75] Inventor: Bernard Capdeboscq, St Just Chaleyssin, France

[73] Assignee: S.A. Martin, Villeurbanne, France

[21] Appl. No.: 905,366

[22] Filed: May 11, 1978

[30] Foreign Application Priority Data

May 13, 1977 [FR] France ..... 77 14638

[51] Int. Cl.[3] ..... B65G 57/30

[52] U.S. Cl. ..... 414/46; 271/212; 414/93; 414/907; 414/114

[58] Field of Search ..... 414/46, 92, 93, 114, 414/907; 271/3.1, 178, 212, 218

[56] References Cited

U.S. PATENT DOCUMENTS

| | | | |
|---|---|---|---|
| 2,749,120 | 6/1956 | Mallory | 271/212 |
| 3,533,620 | 10/1970 | Vasse | 271/212 |
| 3,601,265 | 8/1971 | Shields | 414/907 X |
| 3,744,649 | 7/1973 | Ward | 271/212 X |
| 3,834,290 | 9/1974 | Nelson | 414/92 X |
| 3,866,765 | 2/1975 | Stobb | 271/212 X |

*Primary Examiner*—L. J. Paperner

*Attorney, Agent, or Firm*—Haseltine, Lake & Waters

[57] ABSTRACT

In a machine for separating and discharging products in sheet form, in which the sheets are supplied by a conveyor and stacked in a stacking position defined by a stop abutment associated with the conveyor, each successive sheet being introduced under the preceding sheet in the stacking position, a roller is provided at the upstream lower edge of the stack, the roller having peripheral cogs and being arranged so that the upstream edge of the lowest sheet in the stack rests against it and is raised by rotation of the roller.

2 Claims, 4 Drawing Figures

MACHINE FOR SEPARATING AND DISCHARGING PRODUCTS IN SHEET FORM

FIELD OF THE INVENTION

The present invention relates to a machine for separating and discharging products in sheet form and for use, for example, at the exit of a machine for making corrugated cardboard boxes, for the purpose of delivering the boxes in uniform bundles each containing the same number of boxes, thus making it possible to control exactly the number of boxes supplied.

The machine which forms the subject of the invention uses the process of stacking of the sheets "from below," that is to say each new sheet is introduced below the preceding sheet, at the lower part of the bundle being formed. This arrangement has the advantage of keeping the sheets under slight compression once it is introduced into the bundle, thus facilitating the final glueing of the box.

PRIOR ART

The machine described in French Pat. No. 1,563,177 comprises a belt conveyor which serves to introduce the sheets successively into a magazine where they become superposed. The upper part of the stack can be discharged, by means of a discharge pusher possessing vertical bars, onto a discharge belt conveyor. The machine has a set of separating blades which are introduced at the lower part of the bundle of sheets intended to be discharged, sheets then accumulating under the blades. The blades rise at the rate at which the sheets are introduced under the stack and bring about a separation between the bundle to be discharged and the lower sheets which are held in the magazine. These blades are located opposite the bars of the pusher, and serve as a support for these bars, so as to allow the upper bundle to be ejected without touching the lower stack.

Each new sheet can be introduced under the bottom sheet held in the magazine because the edge of the bottom sheet, on the entry side, is kept at a distance from the belt conveyor and forms an angle therewith. In certain cases, if the rigidity of the sheets is insufficient or if the sheets are of defective planarity, the angle formed between the bottom sheet and the belt conveyor is reduced and problems arise as the sheets enter the magazine.

Devices exist which make it possible to increase the angle formed between the bottom sheet and the belt conveyor, so as to assist the introduction of the sheets. A device of this type comprises sheet lifters which act on the side of the sheets which enters the magazine, on either side of the stack. These lifters are, for example, screw systems. Another device possesses cams which raise the edge, on the entry side, of the bottom sheet. In the case of small machines a construction using such devices becomes difficult and expensive.

SUMMARY OF THE INVENTION

According to the present invention there is provided a machine for separating and discharging products in sheet form comprising a conveyor for transporting sheets individually to a stacking position determined by a stop abutment and in which each successive sheet is introduced under the preceding sheet, a conveyor for discharging a bundle of sheets from the stacking position, separating blades for introduction below a bundle which is being formed in the stacking position and which are adapted to be raised at the rate at which new sheets arrive under the bundle, a pusher comprising substantially vertical bars each arranged opposite a respective one of the separating blades, the bars being movable to push a bundle located above the separating blades onto the discharge conveyor, and a roller provided with peripheral cogs arranged so that the upstream edge of the lowest sheet in the stacking position rests on it and is rotatable for raising the edge of the lowest sheet.

BRIEF DESCRIPTION OF THE DRAWINGS

The invention will be more fully understood from the following description of an embodiment thereof, given by way of example only, with reference to the accompanying drawings.

In the drawings.

DETAILED DESCRIPTION

Figure 1:
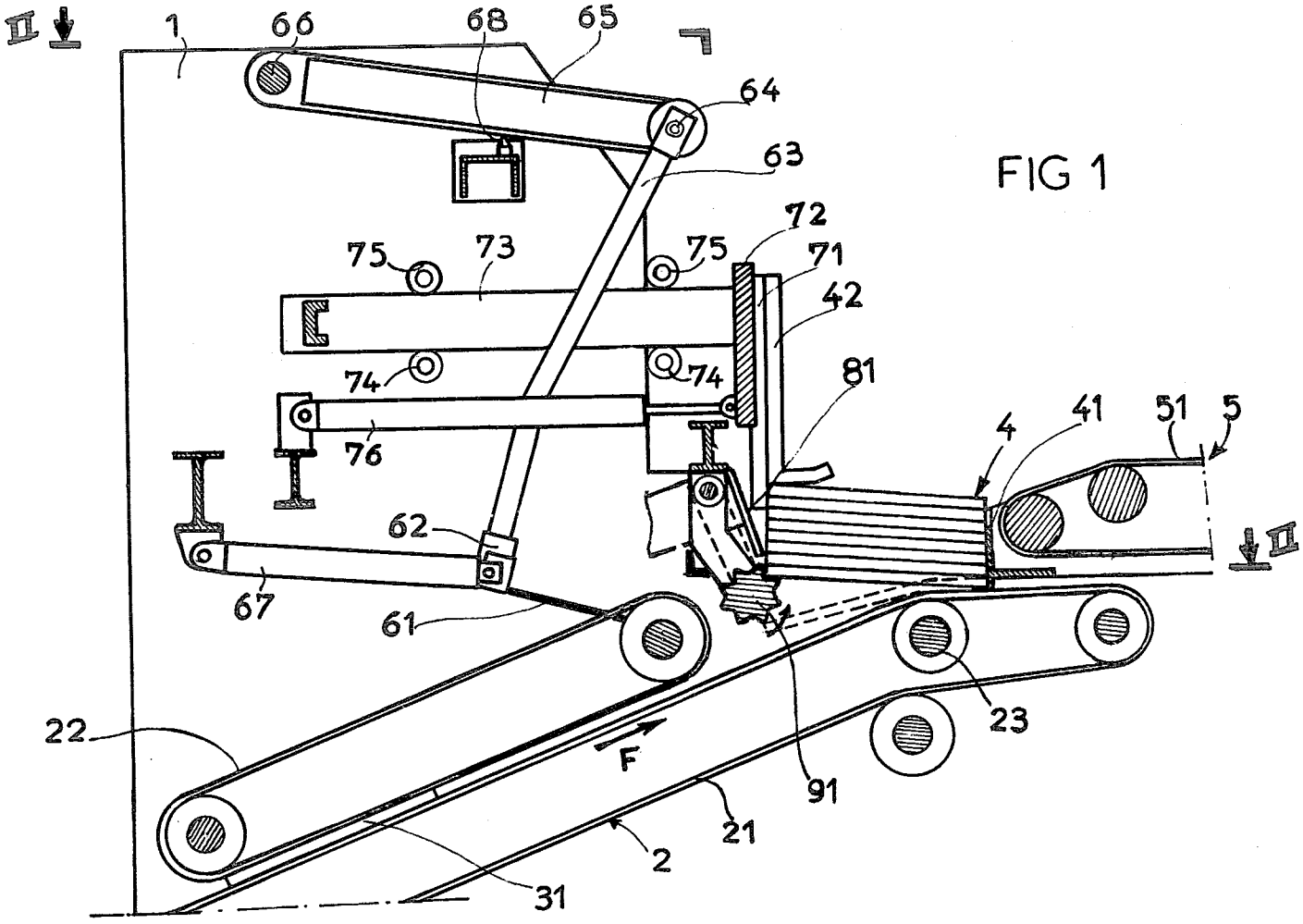
FIG. 1 is a longitudinal section, taken on line I—I in FIG. 2, through an embodiment of a machine according to the present invention.
Figure 2:
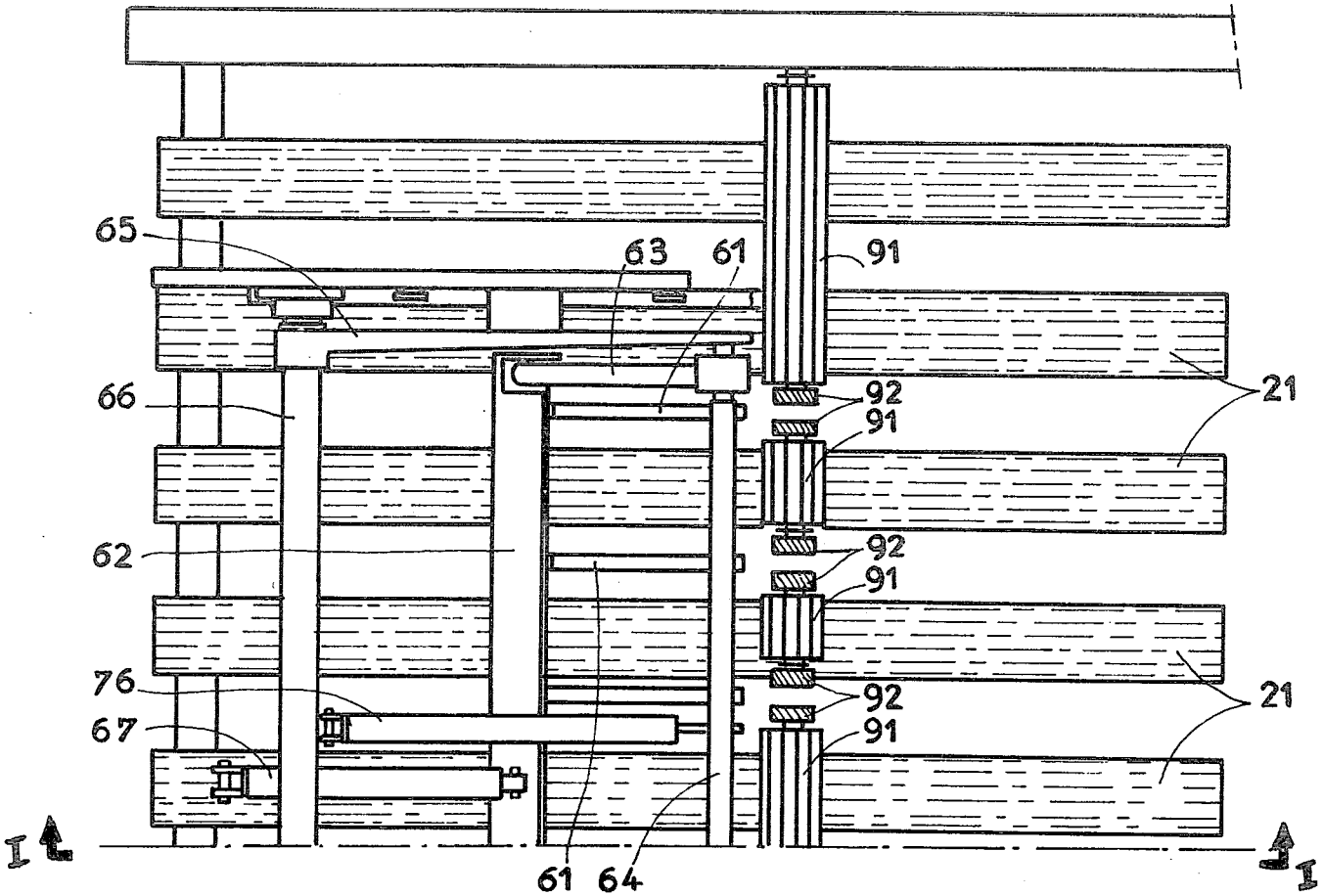
FIG. 2 is a view taken on line II—II in FIG. 1.

The machine shown in FIGS. 1 and 2 comprises a framework 1 which supports a feed conveyor 2. The feed conveyor comprises, for example, a lower set of endless belts 21 and an upper set of endless belts 22.

The conveyor 2 serves to transport sheets 31 individually in the direction of the arrow F.

The sheets are stopped on the feed conveyor 2 in a stacking position determined by a stop plate 41 which is approximately at right angles to the direction of advance of the sheets. This stop plate forms, with the lower belts of the conveyor, a magazine 4 in which the sheets become stacked.

The lower belts 21 travel over a roller 23 so that, upstream of this roller, the belts form an inclined rising transport zone and, downstream of this roller, they form a substantially horizontal transport zone. The transport zone located upstream of the guide roller 23 forms, with the lower sheet held by the stop 41, an angle which allows each rising sheet to be inserted under the stopped preceding sheet.

Downstream of the magazine 4 is located a discharge conveyor 5 whereby bundles of sheets can be discharged in a downstream direction. The conveyor 5, which comprises belts 51, allows the sheets to be discharged at a higher level than the level at which the sheets enter the magazine.

The discharge conveyor 5 is movable horizontally. It is firmly fixed to the stop plate 41 and can thus adapt itself to the format of the sheets to be stacked.

The machine comprises separating blades 61 which can be introduced below a bundle being formed and which can be raised at the rate at which new sheets are introduced into the magazine. Each of these blades 61 is located opposite a gap between the belts. The blades are fixed to a crossbar 62 which is rigidly fixed to arms 63. The arms 63 are attached, by a horizontal axle 64, to suspending arms 65, which are hinged about a horizontal axle 66 on the framework. The blades are pivotable about the axle 64 under the action of a jack 67 pivotally connected to the crossbar 62 and to the framework.

The arms 65, the crossbar 62, the arms 63 and the jack 67 form a hinged unit which, under its own weight, rests with the arms 65 on resilient stops 68.

The machine comprises a pusher which comprises vertical bars 71 and which is operable to push the sheets located above the separating blades 61, horizontally in the downstream direction. Each of the vertical bars 71 is located opposite a separating blade. The bars 71 are fixed to a chassis formed by a crossbar 72 and plates 73 guided horizontally by the rollers 74 and 75. A pneumatic jack 76 articulated on the chassis and the framework moves the chassis.

Reciprocating boards 81 serve to square-up a stack of sheets in the magazine. The drive mechanism of the boards 81 is not shown.

The machine includes a device which make it possible to ensure, economically, that the angle of the entry of the sheets, formed between the stack and the conveyor, is large. This device comprises coaxial rollers 91 provided on the sheet entry side of the magazine. Each roller 91 is provided, at its periphery, with cogs extending parallel to the central axle and each roller is supported at its ends by supports 92 which are firmly fixed to the framework. Each roller is guided about a horizontal axis by bearings and is driven by a drive mechanism comprising an endless chain which engages on a pinion firmly fixed to the roller, and on a drive pinion. The unit formed by each roller, its support and its drive mechanism is inserted between two separating blades 61 so that the latter can lift up. These rollers 91 are located above the lower belts of the conveyor so as to allow the sheets to pass towards the magazine. They are located below the bars of the pusher 71 in the rest position, and below the squaring-up boards 81. The rollers 91 are driven in the direction shown by the arrow in FIG. 1, that is to say so that each cog located on the magazine side travels upwards.

FIGS. 1 and 2 show the machine in a neutral position, that is to say during the simple formation of a stack of sheets on the belts of the stacking conveyor 2, for example at the start of operation of the machine. The jack 76 is retracted, the pusher 71 is in the rear position, the arms 65 rest on the stops 68, the jack 67 is retracted and the separating blades 61 are in the rear position, between the belts, leaving a free passage for the sheets gripped between the two sets of belts of the conveyor 2.

The sheets delivered by the conveyor 2 accumulate in the stacking magazine 4, in abutment with the plate 41, and are aligned by the reciprocating movement of the squaring-up plates 81.

On reaching the stacking magazine, under the preceding sheets, the upstream edge of each sheet is located under the rollers 91, the position of the sheet being shown in broken lines in FIG. 1. The sheet is flexed because its downstream edge rests on the substantially horizontal portion of the conveyor. The upstream edge of the sheet thus tends to come into contact with the rollers 91 which lift it. At the end of the movement, the upstream edge rests on the rollers and the sheet occupies the position shown in solid lines. The whole of the bundle 3 is subjected to the action of a tamping member 42 which rests on the top sheet and which is guided vertically on the support chassis of the pusher bars 71.

Figure 3:
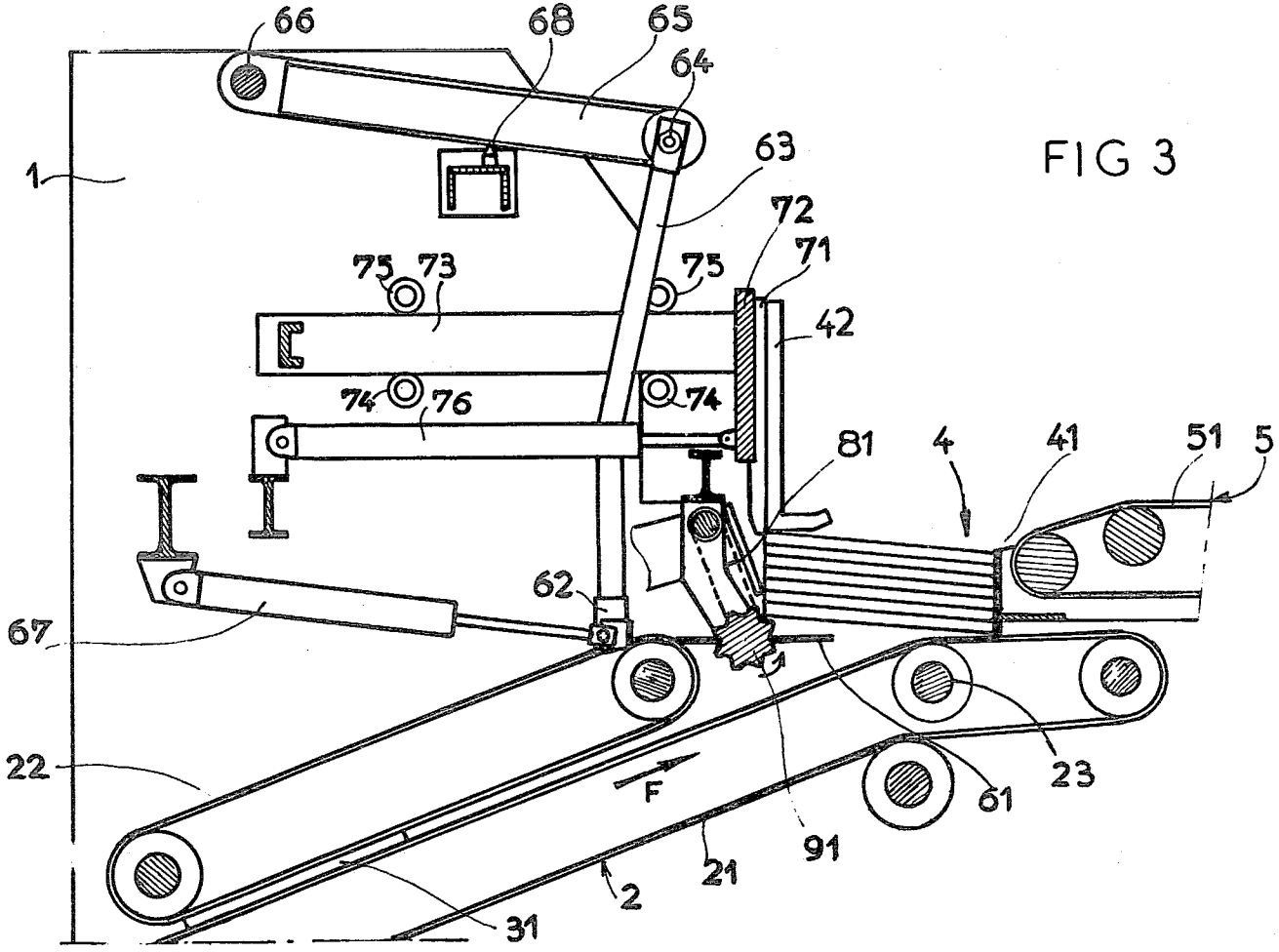
FIGS. 3 and 4 are views similar to that of FIG. 1, but showing different stages of operation of the machine.

When the number of sheets stacked in the stacking magazine reaches a pre-selected number corresponding to the desired number of sheets per bundle, the jack 67 is actuated to bring the separating blades 61 above the stacking conveyor, and below the last sheet introduced into the bundle. FIG. 3 shows the machine immediately after this movement of introducing the separating blades under the bundle being formed.

Figure 4:
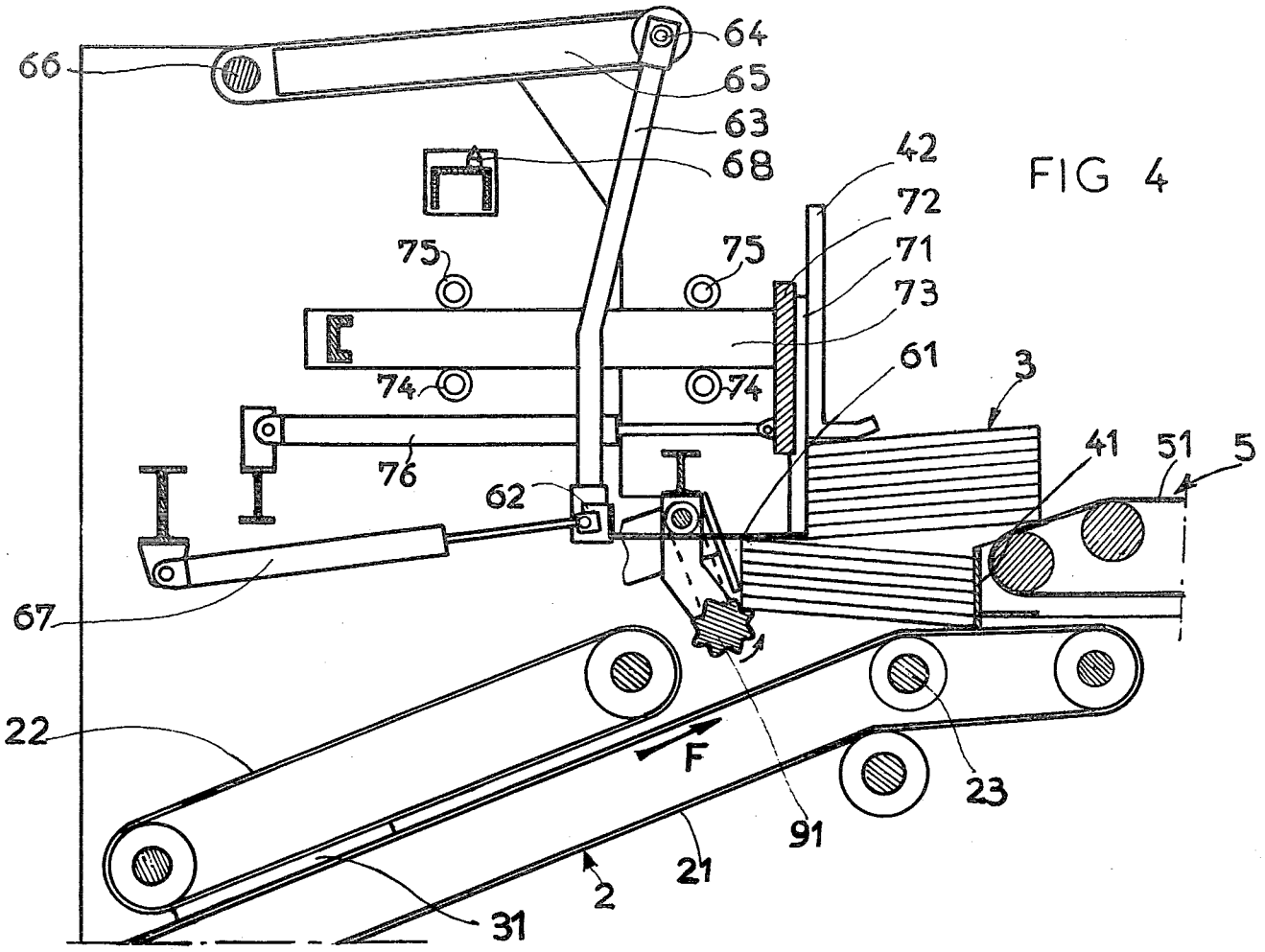

The subsequent sheets continue to position themselves under the bundle formed, but under the separating blades 61 which thus bring about a separation between the two parts of the bundle. At the rate at which the sheets stack under the separating blades, the latter are pushed upwards, the articulated lever unit rises and the arms 65 are lifted off the stops 68. When the blades 61 come into contact with the lower ends of the bars or fingers 71, the jack 76 is actuated and pushes the fingers 71 forward, carrying all the sheets located above the blades 61 towards the discharge conveyor 5. In this movement, shown in FIG. 4, the fingers 71 of the pusher are not in contact with the first sheet of the bundle being formed, which is intended to remain in position, but instead slide on the blades 61 which separate the fingers from this first sheet. Furthermore, the blades 61, by virtue of their own weight and of that of the set of levers which support them, keep the lower part of the stack in position, and this part is thus not affected by the operation of discharging the upper part. After having discharged the upper bundle, the two jacks 67 and 76 are retracted so as to bring the pusher 71 and the set of blades 61 back into the rear position, and once these have been released from the top of the stack they fall back into their lower position, that is to say the waiting position, shown in FIG. 1.

The vertical position of the pusher fingers 71 is regulated so as to allow the cyclic movement of the separating blades to take place, that is to say so that the movement of discharge by the pusher is triggered before the number of sheets corresponding to the selected number per bundle is stacked under the blades, so as to release the separating fingers in time to allow them once again to separate two other bundles.

What is claimed is:

1. A machine for separating and discharging products in sheet form comprising:

a conveyor for transporting sheets individually;

a stop abutment associated with said conveyor and defining therewith a stacking position in which each successive sheet on said conveyor is introduced under the preceding sheet to form a bundle of sheets;

a discharge conveyor for discharging a bundle of sheets from said stacking position;

separating blades positioned for introduction below a bundle of sheets formed in said stacking position, means for raising said blades at the rate at which new sheets arrive under said bundle;

a pusher comprising substantially vertical bars arranged opposite said blades;

means for moving said pusher bars to push a bundle on said separating blades onto said discharge conveyor;

a roller provided with peripheral cogs;

means mounting said roller so that the upstream edge of the lowest sheet in said stacking position rests thereagainst; and means for rotating said roller to raise said edge of said sheet to a position at the bottom of the bundle whereupon the bundle is supported at the lower upstream edge thereof by said roller, said conveyor including an ascending portion and a substantially horizontal portion, said roller being disposed above said ascending portion to support the upstream edge of the lowest sheet of the bundle while the downstream edge of the lowest sheet rests on said substantially horizontal portion of the conveyor, said conveyor comprising a plurality of laterally spaced belts, said blades being movable between the spaced belts, said roller including axially spaced and aligned roller elements disposed above said belts, said vertical bars of said pusher being positioned to be contacted by said blades when the latter are raised whereupon said bars are moved to push the bundle on said blades onto said discharge conveyor.

2. A machine according to claim 1, including tamping means for bearing on said bundle from above.

* * * * *